US006038724A

United States Patent [19]

Chbat et al.

[11] Patent Number: 6,038,724

[45] Date of Patent: Mar. 21, 2000

[54] CLOTHES LOAD ESTIMATION METHOD AND WASHING MACHINE

[75] Inventors: Nicolas Wadih Chbat, Albany; Vivek Venugopal Badami, Schenectady, both of N.Y.

[73] Assignee: General Electric Company, Schenectady, N.Y.

[21] Appl. No.: 09/200,815

[22] Filed: Nov. 27, 1998

[51] Int. Cl.[7] ..... D06F 33/02

[52] U.S. Cl. ..... 8/159; 68/12.04

[58] Field of Search ..... 8/159; 68/12.04

[56] References Cited

U.S. PATENT DOCUMENTS

| | | | |
|---|---|---|---|
| 4,481,786 | 11/1984 | Bashark . | |
| 4,607,408 | 8/1986 | Didier et al. . | |
| 4,835,991 | 6/1989 | Knopp et al. . | |
| 4,862,710 | 9/1989 | Torita et al. . | |
| 5,042,276 | 8/1991 | Kamano et al. . | |
| 5,092,140 | 3/1992 | Matsuo et al. | 68/12.04 |
| 5,161,393 | 11/1992 | Payne et al. . | |
| 5,208,931 | 5/1993 | Williams et al. . | |
| 5,230,228 | 7/1993 | Nakano et al. . | |
| 5,233,847 | 8/1993 | Tanaka . | |
| 5,241,845 | 9/1993 | Ishibashi et al. . | |
| 5,275,025 | 1/1994 | Nakamura et al. | 68/12.04 |
| 5,284,523 | 2/1994 | Badami et al. . | |
| 5,291,626 | 3/1994 | Molnar et al. . | |
| 5,313,964 | 5/1994 | Dausch et al. . | |
| 5,330,580 | 7/1994 | Whipple, III et al. . | |
| 5,577,283 | 11/1996 | Badami et al. . | |
| 5,600,310 | 2/1997 | Whipple, III et al. . | |
| 5,600,961 | 2/1997 | Whipple, III . | |
| 5,669,095 | 9/1997 | Dausch et al. . | |
| 5,669,250 | 9/1997 | Dausch et al. . | |

FOREIGN PATENT DOCUMENTS 0345120 12/1989 European Pat. Off. .

OTHER PUBLICATIONS

"Intelligent Dishwasher Outsmarts Dirt", Andrea Baker, Associate Editor, Design News, Apr. 10, 1995, pp. 67–73.

"Decision–Making in a Fuzzy Environment", R. E. Bellman and L. A. Zadeh, Management Science, vol. 17, No. 4, Dec. 1970, pp. B–141–B–165.

"It washes! It Rinses! It Talks!", Lawrence A. Berardinis, Senior Editor, Machine Design, Sep. 12, 1991, pp. 43–47.

"State–of–th–Art in Household Appliances Using Fuzzy Logic", Alanna Quali and Adnan Shaout, University of Michigan, Dept. of Electrical and Computer Engineering—pp. 204–213.

"Sensor Appliance control, and Fuzzy Logic", Michael Larence Smith, IEEE Transactions on Industry Applications, vol. 30, No. 2, Mar./Apr. 1994, pp. 305–310.

"Introduction to Japanese Consumer Products that Apply Neural Networks and Fuzzy Logic", Hideyuki Takagi, University of California at Berkeley, Computer Science division, pp. 1–8.

"Fuzzy Logic–Based Supervisory Control of Household Appliances", Vivek V. Badami, IEEE, Apr. 1997, pp. 213–217.

"ANFIS: Adaptive–Network–based Fuzzy Inferencing Systems", *IEEE Transactions on Systems, Man and Cybernatics,* vol. 23, No. 3, May 1993, pp. 665–685.

Copending U.S. Patent Application Serial No. 08/968,732, Filed Nov. 12, 1997, by Vivek V. Badami, entitled "Appliance Performance Control Apparatus and Method".

*Primary Examiner*—Philip R. Coe

*Attorney, Agent, or Firm*—Donald S. Ingraham; Douglas E. Stoner

[57] ABSTRACT

A clothes load estimation method for a clothes washer, and a washing machine having a controller for controlling at least one operating condition for a clothes washer, are provided, in which a value of an inertia ($I_c$) of the clothes load is determined in accordance with a relationship to a sensed basket acceleration ($\alpha_o$) and a sensed motor phase angle ($\phi_m$). The relationship is based on and derived from a dynamic modeling of a motor/inner clutch subsystem, an outer clutch, subsystem, a belt subsystem, and a washer basket/clothes load subsystem. The method and apparatus require only low cost motor phase sensors and either velocity or position sensors in controlling the washer operating condition.

24 Claims, 5 Drawing Sheets

CLOTHES LOAD ESTIMATION METHOD AND WASHING MACHINE

BACKGROUND OF THE INVENTION

The invention relates to a method for estimating a weight or load of clothes in a clothes washer, and a washing machine controller operating using the method, and more specifically to an estimation method employing low cost velocity or position sensors.

The weight of a load of clothes loaded into a clothes washer for washing is an important parameter in determining the proper amount of water and detergent to be used for the wash cycle. Large clothes loads require larger quantities of water than do small loads. Better clothes washability and significant water and energy savings can be achieved when the proper amount of water is filled into the washer tub for a given clothes load. Too much water or detergent is wasteful, and too little of either will generally adversely affect the effectiveness of the washing, and may result in increased energy consumption due to a higher load on the motor as a result of the inability of the clothes to move freely in the water.

Several U.S. patents are directed to estimation of the load of clothes loaded into a washer. Estimation techniques or methods employed by the washer itself are desirable in that it eliminates guesswork on the part of the machine operator which can lead to improper water fill or use of an improper amount of detergent.

Other patents, for example, U.S. Pat. Nos. 4,607,408, 5,577,283, and EU 0345120A1, employ a dynamic model of the basket/clothes and motor in performing clothes load estimation. The dynamic model in the '283 patent, for example, is expressed as:

$$T_b - T_f = (I_c + I_b)\alpha_b$$

where $T_b$ is the torque provided by the motor to the basket, $T_f$ is the frictional torque of the rotational system (that is, basket or drum), $I_c$ and $I_b$ are the moments of inertia of the clothes and basket respectively, and $\alpha_b$ is the angular acceleration of the basket.

The primary limitation of the system of the '283 patent is the assumption that the applied torque ($T_b - T_f$) is the same regardless of the load size or aging effects of washer parts (such as the clutch mechanism). This assumption can be violated in practice because mechanical components age with usage in unpredictable ways. Therefore, a better load estimation technique, that is robust to variabilities in the applied torque is desirable. In addition, it is desirable to have a low cost implementation of the load sensing approach.

BRIEF SUMMARY OF THE INVENTION

Using a dynamic model of moving components in the washer, the clothes load is estimated by obtaining a value of the moment of inertia of the clothes present in the washer basket, and using the inertial value, with a lookup table or an inference system, to estimate the actual clothes weight. An estimated clothes weight signal is typically used by a washer controller for controlling the amount of water to be filled into the washer tub.

BRIEF DESCRIPTION OF THE DRAWINGS

These and other features, aspects and advantages of the present invention will become better understood when the following detailed description is read with reference to the accompanying drawings, wherein like numerals refer to like components in the figures, and.

DETAILED DESCRIPTION OF THE INVENTION

Figure 1:
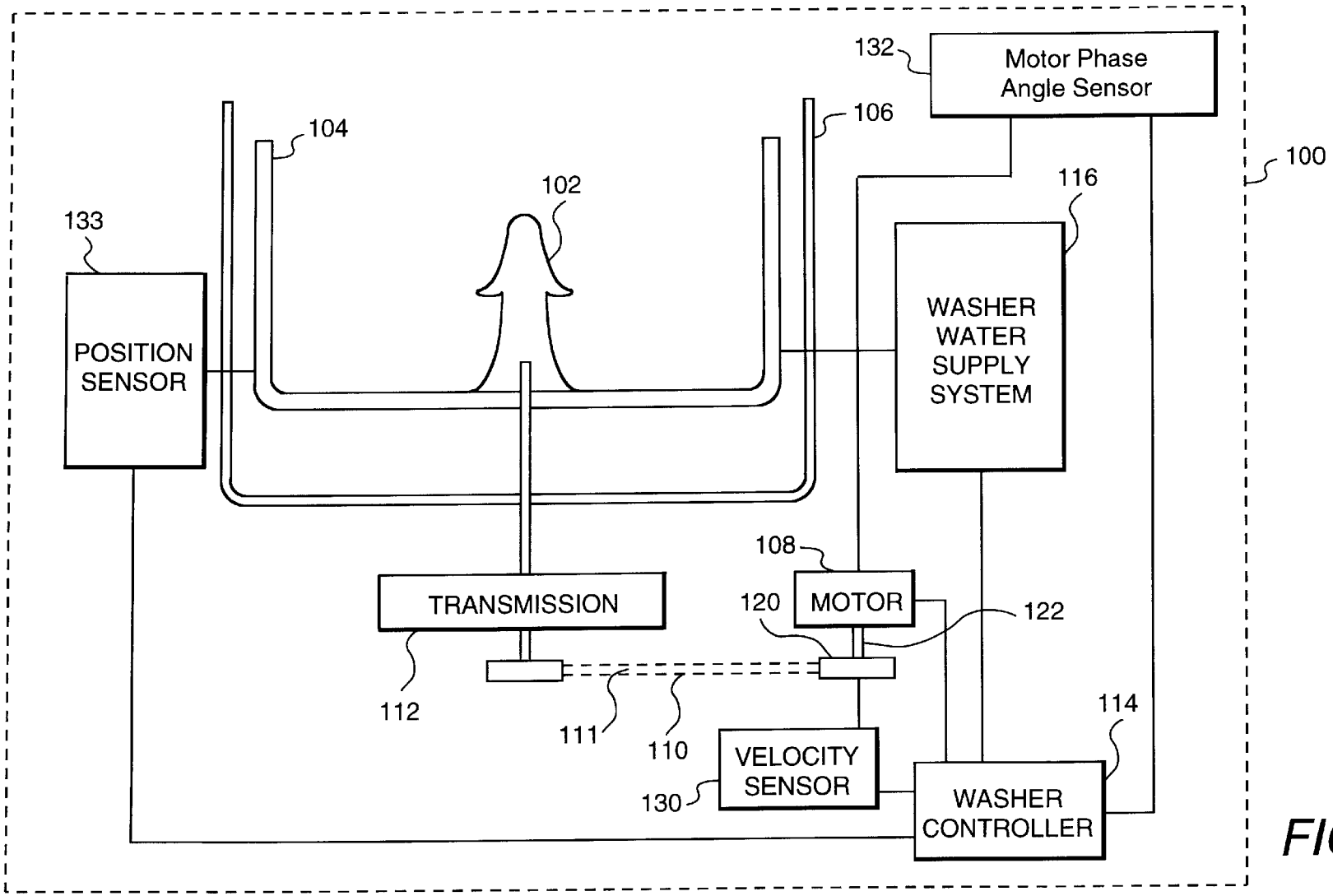
FIG. 1 is a substantially schematic view of a clothes washer suitable for use in an embodiment of the present invention.
Figure 2:
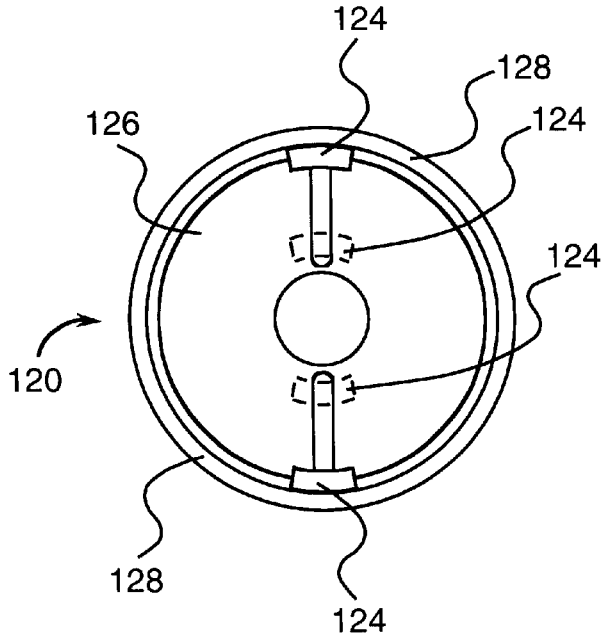
FIG. 2 is a substantially schematic end view of a clutch assembly for coupling a motor to a drive belt.
Figure 3:
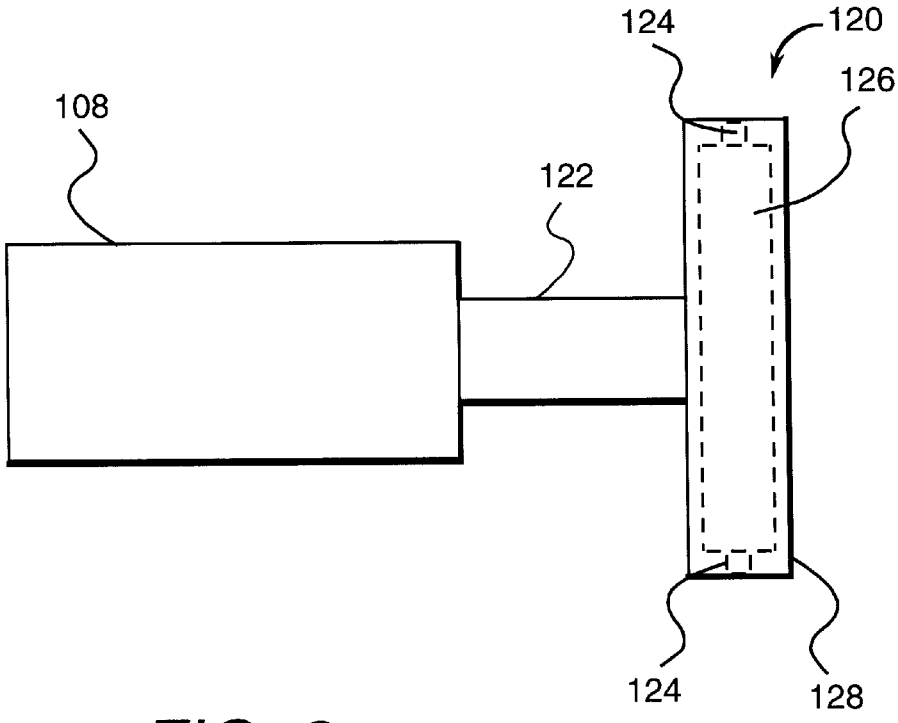
FIG. 3 is a substantially schematic side view of the clutch assembly of FIG. 2, as coupled to a motor.

FIG. 1 is a substantially schematic view of a representation vertical-axis clothes washer 100 to which one embodiment of the method of the present invention pertains. FIGS. 2 and 3 illustrate schematically the motor and clutch components suitable for use in washer 100. The washer 100 includes an agitator 102 disposed within basket 104 and surrounding tub 106. A motor 108 is coupled to the basket 104 by a belt-and-pulley arrangement 110 and a transmission 112. A washer controller 114 is commonly provided to control one or more parameters such as motor speed and the amount and temperature of the water delivered to the tub 106 by washer water supply system 116.

By comparison to a model based upon equation (1) in the description of the related art, the method of the present invention employs a more detailed breakdown of the washer dynamics. More specifically, four dynamic models of various subparts or subassemblies are developed and employed in the clothes load estimation method of the present invention.

For dynamic modeling purposes in connection with the present invention, a first subassembly consists of the motor rotor and clutch, the second subassembly is the outer housing of the clutch, the third subassembly is the drive belt, and the fourth subassembly (subpart) is the basket and the clothes contained therein.

One example of the modeling and the estimation method of the invention can be illustrated in the context of the process by which the basket containing the clothes load is moved in the spin cycle (the spin cycle is used to extract water from clothes after a washing cycle). Prior to the start of the wash cycle, the motor 108 is not engaged, and the basket 104 and clutch 120 are effectively stationary. The motor 108 is started as part of the commencement of the wash cycle, and a few milliseconds following the motor startup, the motor reaches constant angular speed, as does an inner clutch 126, which is rigidly attached to a motor shaft 122. The centrifugal motion impels clutch shoes 124 of the inner clutch 126 to slide radially outwardly into frictional engagement with the outer clutch housing 128. Once this engagement is accomplished, the basket 104 commences rotation, since the outer clutch housing is operatively coupled to the basket by pre-tensioned belt 111 (while the clutch housing is coupled in this manner to the basket, the two components effectively form a single clutch outer housing-basket assembly that rotates at the same speed and direction). In a phase referred to herein as a "catch up" (or alternatively an "acceleration" phase), the outer housing 128 and basket 104 increase in rotational speed, and eventually reach full speed. "Full speed" is used herein to connote the speed of the clutch outer housing-basket assembly once these coupled components catch up to the speed of the inner clutch 126.

In the method of the present invention, at least two readings of the rotational speed of the clutch outer housing-basket assembly are taken by a velocity or position sensor 130 during the acceleration phase. The readings are taken to compute the rate of acceleration of the clutch outer housing-basket assembly. In the method of the present invention, the clothes load is estimated using the sensed and calculated acceleration rate and a reading of the motor phase angle sensed, by a motor phase angle sensor 132, during the same period of time that the clutch outer housing-basket assembly speeds were obtained. In the equations involved in the dynamic modeling employed in the method of the present invention, the following nomenclature is used in the subscripts of the parameters:

i=inner clutch
o=outer clutch
m=motor
f=dynamic friction
c=clothes
b=basket
w=water The dynamic description or modeling of the moving parts in accordance with one embodiment of the present invention is set forth below, with the description being broken down by subassembly or subpart as noted in the headings.

The modeling of the inner clutch is preferably represented by the relationships set forth as follows:

$$\Sigma M_A = I_i \alpha_i (\oplus ccw)$$
$$T_m - T_f = I_i \alpha_i \quad (2)$$

Where $\Sigma M_A$ represents the sum of moments about the center axis of the motor, taken in a counter-clockwise direction.

Figure 4:
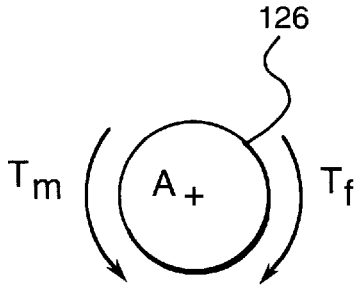
FIG. 4 is a representation of an inner clutch employed in driving a clothes basket in a clothes washer, identifying the parameters upon which the clutch is modeled in the method of the present invention.

FIG. 4 shows schematically a cross section of the inner clutch 126 which is rigidly attached to motor shaft 122 (FIGS. 2, 3), the center of which is represented by numeral 150. The terms $I_i$ and $\alpha_i$ in equation (2) represent the moment of inertia and the angular acceleration of the motor rotor of the inner clutch assembly, respectively. $T_m$ and $T_f$ are, respectively, the torque provided by the motor to the basket, and the frictional torque of the basket.

The inner clutch assembly typically has two components. The first component commonly is rigidly attached to motor shaft 122. The second component includes clutch shoes 124, which are free to slide radially outwardly in order to functionally engage the outer housing 128 of the clutch. As represented schematically in FIGS. 2 and 3, the inner clutch assembly includes disc 126 that allows the clutch shoes to slide radially outward in slots. The specific construction of the inner clutch is not, however, critical to the invention.

Also, for the type of motor commonly used, which is a single phase induction motor, the following relationship exists:

$$T_m = K_m \phi_m \quad (3)$$

where $\phi_m$ is the electrical phase angle of the motor and $K_m$ is a proportionality constant. This expression is valid within the range of operation of the spin cycle.

Figure 5:
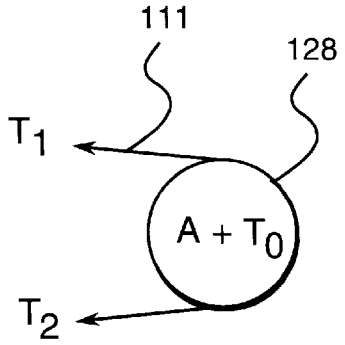
FIG. 5 is a schematic representation of the parameters involved in modeling the outer clutch and belt in accordance with the method of the present invention.
Figure 6:
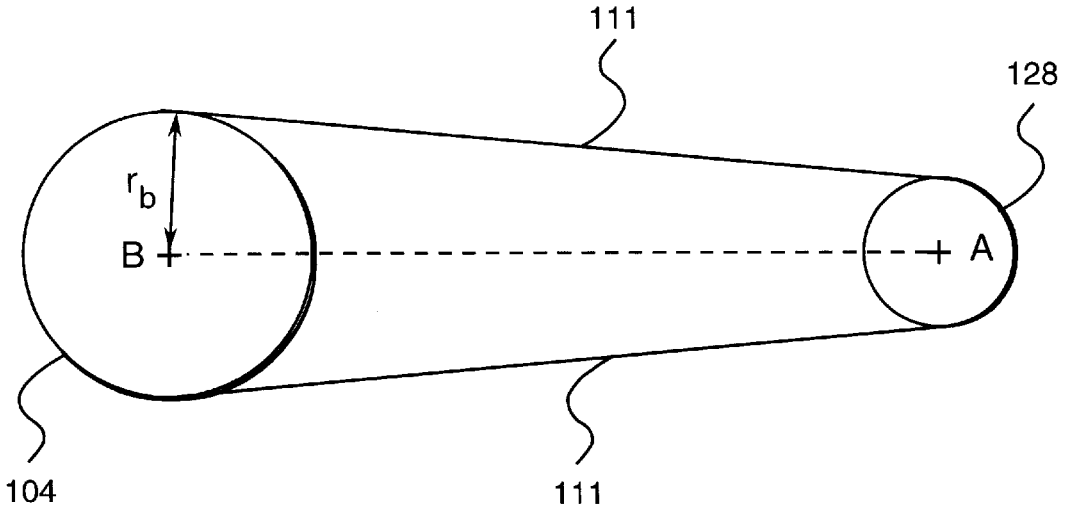
FIG. 6 is a schematic representation of the parameters involved in modeling the basket in accordance with the method of the present invention.

The outer clutch 128 is the housing that encloses the inner clutch 126. The outer clutch is attached to the belt 111 that in turn wraps around the basket 104 (FIGS. 5, 6). FIG. 5 schematically shows the outer clutch and the belt tension components on the belt that are coupled to the outer clutch. The following relationships exist for this subsystem:

$$\Sigma M_A = I_o \alpha_o (\oplus ccw) \quad (4)$$

$$T_1 r_o - T_2 r_o + T_f = I_o \alpha_o \quad (5)$$

Also, $$\frac{T_1}{T_2} = e^{\mu\theta} \quad (6)$$

$T_1$ and $T_2$ are the tension side and slack side tension forces, respectively, of the belt. Equation (6) is the widely accepted belt equation which states that the tension ratio is an exponential function of the coefficient of friction, $\mu$, between the belt and the outer clutch, and $\theta$ is the angle of wrap of the belt around the outer clutch. Also, the moment of inertia of the belt is a constant that can be combined with, for example, the basket inertia. Generally, this term can be ignored as it is negligible compared to the basket inertia.

The modeling of the behavior of the basket, which is typically operatively coupled to the outer clutch, as shown schematically in FIG. 6, is as follows:

$$\Sigma M_B = (I_b + I_c) \alpha_b (\oplus ccw) \quad (7)$$

Equation 7 gives $$-T_1 r_b + T_2 r_b - T_{fb} = (I_b + I_c) \alpha_b \quad (8)$$

where $T_{fb}$ is the frictional torque between the rotational axis of the basket and its surrounding bearing material, and all other variables are defined above. Solving for $T_2$ in equation (6), and substituting in equation (8) gives $$\frac{T_1 r_b}{e^{\mu\theta}} - T_1 r_b - T_{fb} = (I_b + I_c) \alpha_b \quad (9)$$

Using equation (9) and the fact that:

$$\alpha_b r_b = \alpha_o r_o \quad (10)$$

gives $$T_1 r_b \left( \frac{1}{e^{\mu\theta}} - 1 \right) - T_{fb} = (I_b + I_c) \frac{r_o}{r_b} \alpha_o \quad (11)$$

$T_{fb}$ is minimal compared to the other terms in equation (8) and thus can be disregarded. $T_{fb}$ can alternatively be approximated with a constant, for the expected range of angular velocity of the basket 104, throughout the derivation without any loss of generality. Hence, solving equation 11 for $I_c$ (and neglecting $T_{fb}$) gives $$I_c = r_b \underbrace{T_1\left(\frac{1}{e^{\mu\theta}} - 1\right)}_{\Psi} \frac{r_b}{r_o \alpha_o} - I_b \tag{12}$$

The following shows the solution for the expression Ψ in equation (12) by using equations (2), (3), (5), and (6). It is also to be noted that, during the catch up period, $\alpha_i=0$, since the inner clutch assembly acceleration is zero beyond a few milliseconds of motor startup.

From equation (5), $$r_o(T_1-T_2)+T_f=I_o\alpha_o \tag{13}$$

Substituting for $T_2$ from equation (6), and for $T_f$ from equation (3) into equation (13) gives, $$r_o\left(T_1 - \frac{T_1}{e^{\mu\theta}}\right) + K_m\phi_m = I_o\alpha_o \tag{14}$$

thus, $$\frac{I_o\alpha_o - K_m\phi_m}{r_o} = T_1\left(1 - \frac{1}{e^{\mu\theta}}\right) \equiv \Psi \tag{15}$$

Substituting the expression for ψ into equation (12) gives:

$$I_c = r_b\left(\frac{I_o\alpha_o - K_m\phi_m}{r_o}\right)\frac{r_b}{r_o\alpha_o} - I_b \tag{16}$$

Rearranging equation (16) yields:

$$\alpha_o\left[I_o + (I_c + I_b)\left(\frac{r_o}{r_b}\right)^2\right] = K_m\phi_m \tag{17}$$

Equation (17) can then be used during the catch up period where the clutch is not fully engaged. The driving torque from the motor, which is represented in the right hand side of equation (17), drives a system which has an effective inertia as expressed in the brackets, and that is rotating with angular acceleration $\alpha_o$. It should be noted that the relationship expressed in equation (17) resembles equation (1) except that in Eq. (17) the outer housing's inertia appears in the equation. Parameter $I_o$ by itself is small compared to the sum $I_c+I_b$, however, it is included because the term $I_c+I_b$ is multiplied by a gear ratio that is less than one.

In order to conduct the method of the present invention, washer 100 is typically equipped with a motor electrical phase angle sensor 132 and a velocity sensor 130 operatively coupled to the outer clutch (as illustrated in FIG. 1). Alternatively, a basket velocity sensor 133 that is operatively coupled to detect basket speed can be used (both types of sensors can be used in one machine, but typically only one would be used due to cost considerations). Sensors 130, 132 (or 133) are coupled to motor controller 114. When the basket is accelerating with a particular load, parameters $\phi_m$ and $\alpha_o$ change but all other terms in the equation (17) remain constant. A value for parameter $\phi_m$ is obtained from an output of motor phase angle sensor 132, and value for parameter $\alpha_o$ is obtained or calculated from an output of the outer clutch sensor 130, or alternatively basket velocity sensor 133. The bracketed expression on left hand side of equation (17) has only one term that varies from load to load, and that is the inertia of the load $I_c$. Hence, dividing both sides by $\alpha_o K_m$ gives:

$$\frac{1}{K_m}\left[I_o + (I_c + I_b)\left(\frac{r_o}{r_b}\right)^2\right] = \frac{\phi_m}{\alpha_o} \tag{18}$$

Figure 7:
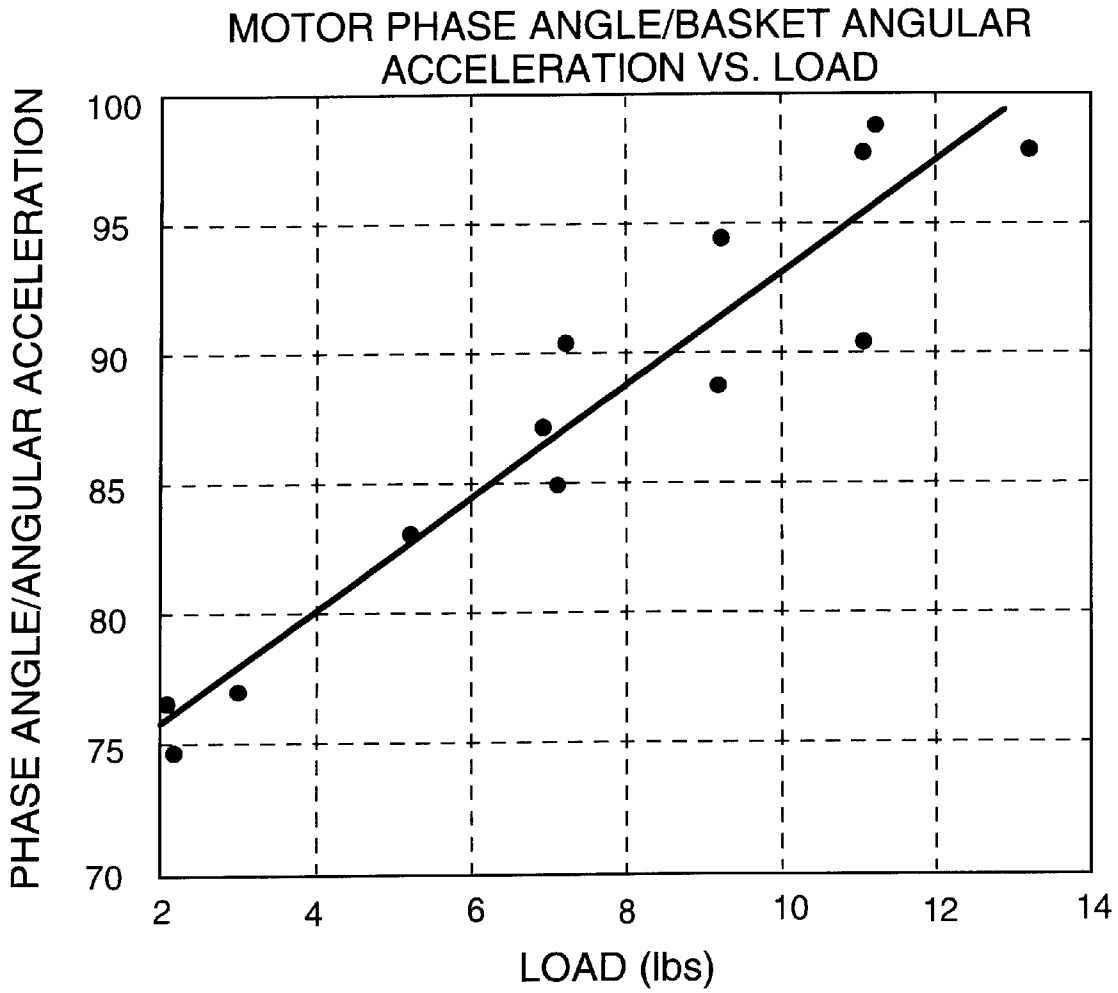
FIG. 7 is a plot of experimental data showing the result or quotient of the motor phase angle divided by the angular acceleration of the clothes basket, plotted versus the load size (weight).

FIG. 7 shows a graph of experimental data of the motor's electrical phase angle divided by the angular acceleration of the basket versus load size. The straight line plotted is a least squares fit to the data which consisted of pure cotton, pure polyester, and blend (50% cotton, 50% polyester) loads of sizes varying from 2 to 13 lb. The trend signifies a linear relationship between the right hand side of equation (18) and the independent variable of the left hand side, which is $I_c$.

A general equation of a straight line is y=ax+b, with the x-axis being the horizontal axis, the y-axis being the vertical axis, and with "a" being the slope, and "b" being the y-intercept. Rearranging equation (18) into this format gives:

$$\frac{\phi_m}{\alpha_o} = \frac{\left(\frac{r_o}{r_b}\right)^2}{K_m} I_c + \frac{I_o + \left(\frac{r_o}{r_b}\right)^2 I_b}{K_m} \tag{19}$$

For normal operation the coefficients "a" and "b" are pre-computed and stored in the ROM space of the washer controller.

Some users start filling the washing machine as the clothes are being added to the basket. In this case, equation (19) is slightly modified to include the inertia of the known amount of water $I_w$ based on knowing flow rates and fill times. Namely, $$\frac{\phi_m}{\alpha_o} = \underbrace{\frac{\left(\frac{r_o}{r_b}\right)^2}{K_m}}_{a} I_c + \underbrace{\frac{I_w + I_o + \left(\frac{r_o}{r_b}\right)^2 I_b}{K_m}}_{b} \tag{20}$$

where, again, the independent variable, inertia of the clothes $I_c$, is the only unknown, given that the values for the motor phase angle $\phi_m$ and angular acceleration $\alpha_o$ are obtained by sensors, and $I_c$ hence can be solved for.

Figure 8:
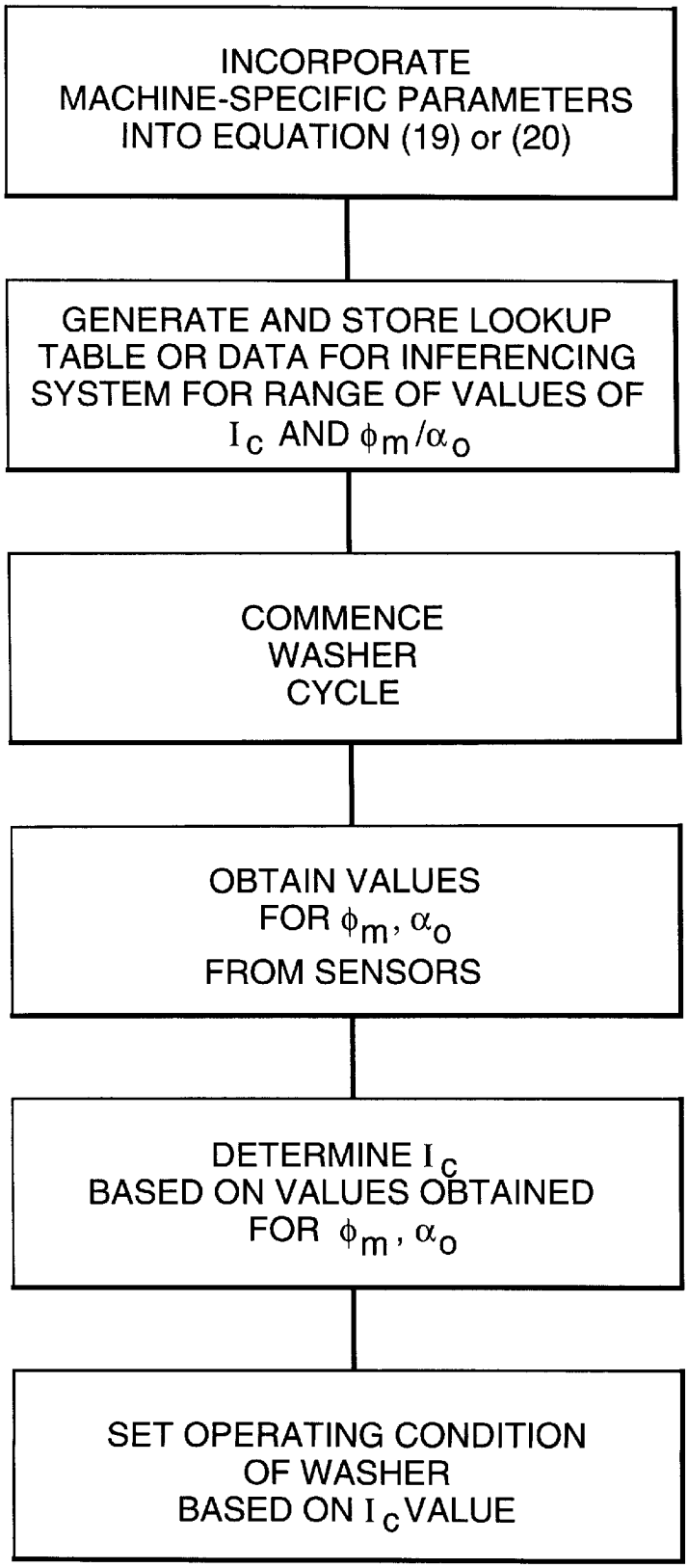
FIG. 8 is a flow diagram of the steps in the method of the present invention.

Thus, with the relationships derived as set forth above, the method of the present invention for performing a clothes load estimation, and for controlling one or more operating conditions based on said estimation, is set forth in the flow diagram of FIG. 8. The method basically involves solving equation (19) or (20).

The method further includes inputting values of "a" and "b" specific to a particular washing machine design which will not vary from washer load to washer load, but may vary from one machine design to another. As noted previously, equations (19) and (20) were specifically rearranged in the format of an equation of a straight line, and wherein only $\phi_m/\alpha_o$ and $I_c$ would be variables once machine design-dependent values for the other parameters were equations.

The method of the present invention comprises further generating and storing a lookup table in a memory of washer controller 114, which contains a set of values of the inertia of the clothes load $I_c$ as a function of clothes mass (lbs). An output representing a control signal based on the estimated clothes load for the calculated inertia is generated and sent.

The clothes load estimation method has the further step of commencing operation of the washer, referred to in the FIG. 8 flow diagram as commencing a washer cycle. It is to be noted that the term "cycle" is not intended to refer to any specific commonly understood "cycle", such as a rinse cycle, but rather to the complete set of cycles in effecting a start-to-finish washing of the clothes load.

In the initial "acceleration" or "catch-up" phase, in which the basket is coming up to full speed, the method involves sensing the motor phase angle, and either the velocity or position of the basket or the outer clutch, at two or more discrete points in time, to obtain values for $\phi_m$ and to enable the calculation of a value for $\alpha_o$. The method then involves relaying the sensed values to the washer controller for a determination of $I_c$ based on the values of $\phi_m$ and $\alpha_o$ obtained.

The method further involves the setting or control of an operating condition, such as the amount of water to be filled into the washer tub, based on the clothes load estimated for the value of $I_c$ obtained. It may be possible and desirable to control or set other operating conditions or parameters. For example, if the washer were equipped with an automatic detergent dispenser, the amount of detergent to be added could be controlled. However, control of the amount of water used appears at present to be the most advantageous use of the present method.

An important benefit to this method is that load estimation in a washer is independent of belt and clutch variations. In addition, aside from a phase angle sensor, the cost of which is marginal, a simple velocity or position sensor in conjunction with the controller is used to generate an effective estimate of the load in a washer. Knowing the load in a washer lends itself directly to adaptively fill the tub to the optimal water level. Not only does an optimal water level save energy and water, it promotes clothes care as well.

The embodiment of the present invention presented above provides dynamic modeling of moving parts in the washing machine, and thus is robust for use over the life of the appliance. The particular equations presented are based on the architecture of a vertical axis washer; similar modeling can be developed as outlined above for other architectures, such as a horizontal axis washer.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for estimating a clothes load in a washing machine comprising the steps of:

sensing, at least at a first time and a second time during an initial acceleration phase of a wash cycle, a rotational speed of a washer component coupled to said clothes load;

calculating an acceleration ($\alpha_o$) of said washer component from said sensed rotational speeds;

sensing, at said at least first and second times, a motor phase angle ($\phi_m$) of a single phase induction motor used in said washing machine to drive a washer basket;

determining an inertia ($I_c$) of said clothes load based on a predetermined relationship between clothes load inertia ($I_c$) and a quotient of said motor phase angle ($\phi_m$) divided by said washer component acceleration ($\alpha_o$).

2. A method as set forth in claim 1, wherein said predetermined relationship is:

$$\frac{\phi_m}{\alpha_o} = \frac{\left(\frac{r_o}{r_b}\right)^2}{K_m} I_c + \frac{I_o + \left(\frac{r_o}{r_b}\right)^2 I_b}{K_m}$$

wherein $r_o$ is a radius of an outer clutch employed to drive a washer basket of radius $r_b$ by a belt drive, $I_o$ is an inertia of said outer clutch, $I_b$ is an inertia of said washer basket, and $K_m$ is a proportionality constant, and wherein $r_o$, $r_b$, $I_o$ and $I_b$ have fixed values based on a predetermined washing machine design.

3. A method as set forth in claim 1, wherein said predetermined relationship is:

$$\frac{\phi_m}{\alpha_o} = \frac{\left(\frac{r_o}{r_b}\right)^2}{K_m} I_c + \frac{I_w + I_o + \left(\frac{r_o}{r_b}\right)^2 I_b}{K_m}$$

wherein $r_o$ is a radius of an outer clutch employed to drive a washer basket of radius $r_b$ by a belt drive, $I_o$ is an inertia of said outer clutch, $I_b$ is an inertia of said washer basket, $I_w$ is an inertia of a water fill prefilled into said washer basket prior to a clothes load being placed in said washer basket, and $K_m$ is a proportionality constant, and wherein $r_o$, $r_b$, $I_o$, $I_b$ and $I_w$ have fixed values based on a predetermined washing machine design.

4. A method as set forth in claim 1, wherein said washer component is a washer basket.

5. A method as set forth in claim 1, wherein said washer component is an outer clutch of a clutch assembly coupling said motor to a washer basket.

6. A method as set forth in claim 1 comprising the further steps of generating lookup table data for values of said clothes load inertia ($I_c$) corresponding to a plurality of quotient values of motor phase angle ($\phi_m$) divided by component acceleration ($\alpha_o$), and storing said lookup table data in a processor in a washer controller.

7. A method as set forth in claim 1 comprising the further step of controlling at least one washing machine operating condition based on said clothes load estimated from said clothes load inertia value obtained.

8. A method as set forth in claim 7, wherein said at least one washing machine operating condition is selected from the group consisting of the amount of water to be added to a washer tub, the temperature of the water to be added to said washer tub, and the amount of detergent to be dispensed into said washer tub.

9. A method for controlling operation of at least one operating condition in a washing machine comprising:

estimating a clothes load present in a washer basket, by the steps of:

sensing, at least at a first time and a second time during an initial acceleration phase of a wash cycle, a rotational speed of a washer component coupled to said clothes load;

calculating an acceleration ($\alpha_o$) of said washer component from said sensed rotational speeds;

sensing at said at least first and second times, a motor phase angle ($\phi_m$) of a single phase induction motor used in said washing machine to drive a washer basket;

determining an inertia ($I_c$) of said clothes load based on a predetermined relationship between clothes load inertia ($I_c$) and a quotient of said motor phase angle ($\phi_m$) divided by said washer component acceleration ($\alpha_o$), determining an estimate of the clothes load corresponding to the clothes load inertia ($I_c$); and using said clothes load estimate as an input to an operating condition control device.

10. A method as set forth in claim 9, wherein said predetermined relationship is:

$$\frac{\phi_m}{\alpha_o} = \frac{\left(\frac{r_o}{r_b}\right)^2}{K_m} I_c + \frac{I_o + \left(\frac{r_o}{r_b}\right)^2 I_b}{K_m}$$

wherein $r_o$ is a radius of an outer clutch employed to drive a washer basket of radius $r_b$ by a belt drive, $I_o$ is an inertia of said outer clutch, $I_b$ is an inertia of said washer basket, and $K_m$ is a proportionality constant, and wherein $r_o$, $r_b$, $I_o$ and $I_b$ have fixed values based on a predetermined washing machine design.

11. A method as set forth in claim 9, wherein said predetermined relationship is:

$$\frac{\phi_m}{\alpha_o} = \frac{\left(\frac{r_o}{r_b}\right)^2}{K_m} I_c + \frac{I_w + I_o + \left(\frac{r_o}{r_b}\right)^2 I_b}{K_m}$$

wherein $r_o$ is a radius of an outer clutch employed to drive a washer basket of radius $r_b$ by a belt drive, $I_o$ is an inertia of said outer clutch, $I_b$ is an inertia of said washer basket, $I_w$ is an inertia of a water fill prefilled into said washer basket prior to a clothes load being placed in said washer basket, and $K_m$ is a proportionality constant, and wherein $r_o$, $r_b$, $I_o$, $I_b$ and $I_w$ have fixed values based on a predetermined washing machine design.

12. A method as set forth in claim 9, wherein said washer component is a washer basket.

13. A method as set forth in claim 9, wherein said washer component is an outer clutch of a clutch assembly coupling said motor to a washer basket.

14. A method as set forth in claim 9 comprising the further steps of generating lookup table data for values of said clothes load inertia ($I_c$) corresponding to a plurality of quotient values of motor phase angle ($\phi_m$) divided by component acceleration ($\alpha_o$), and storing said lookup table data in a processor in a washer controller.

15. A method as set forth in claim 9 comprising the further step of controlling at least one washing machine operating condition based on said clothes load estimated from said clothes load inertia value obtained.

16. A method as set forth in claim 15, wherein said at least one washing machine operating condition is selected from the group consisting of the amount of water to be added to a washer tub, the temperature of the water to be added to said washer tub, and the amount of detergent to be dispensed into said washer tub.

17. A washing machine comprising:

a motor, a clutch assembly, a washer basket operatively coupled to said motor by said clutch assembly, means for estimating a clothes load present in said washing machine, and means for controlling at least one washing machine operating condition, wherein said clothes load estimating means further comprises:

means for sensing a rotational speed of a predetermined washer component coupled to said clothes load;

means for calculating an acceleration of said washer component based on said sensed rotational speed;

means for sensing a motor phase angle of said motor;

means for determining an inertia ($I_c$) of said clothes load employing a predetermined relationship between said inertia ($I_c$) and said calculated washer component acceleration and said sensed motor phase angle;

means for correlating said clothes load inertia ($I_c$) to an estimated clothes load in said washing machine; and wherein said controlling means is operatively coupled to said clothes load estimating means and said controlling means controls at least one washing machine operating condition based on said clothes load estimate.

18. A washing machine as set forth in claim 17, wherein said at least one operating condition is an amount of water used in a wash cycle.

19. A washing machine as set forth in claim 17, wherein said rotational speed sensing means comprises a velocity sensor.

20. A washing machine as set forth in claim 19, wherein said washer component comprises a washer basket.

21. A washing machine as set forth in claim 19, wherein said washer component comprises an outer clutch of said clutch assembly coupling said motor to said washer basket.

22. A washing machine as set forth in claim 19, wherein said washer component comprises an outer clutch of a clutch assembly coupling said motor to said washer basket.

23. A washing machine as set forth in claim 17, wherein said rotational speed sensing means comprises a position sensor.

24. A washing machine as set forth in claim 23, wherein said washer component comprises a washer basket.

* * * * *